US005996258A

United States Patent [19]

Simmons

[11] Patent Number: 5,996,258

[45] Date of Patent: Dec. 7, 1999

[54] PROTECTIVE SHOE COVER

[76] Inventor: Randy Lamont Simmons, 133 Glenshire Dr., Columbia, S.C. 29203

[21] Appl. No.: 09/099,675

[22] Filed: Jun. 19, 1998

[51] Int. Cl.[6] ..... A43B 13/22; A43B 3/18

[52] U.S. Cl. ..... 36/72 R; 36/7.2; 36/7.1 R

[58] Field of Search ..... 36/7.1 R, 7.2, 36/7.4, 7.7, 72 R, 45, 97

[56] References Cited

U.S. PATENT DOCUMENTS

| | | | |
|---|---|---|---|
| 2,079,331 | 5/1937 | Nyhagen | 36/7.4 |
| 2,257,901 | 10/1941 | De Noronha | 36/7.4 |
| 2,292,770 | 8/1942 | Platkin | 36/7.2 |
| 3,324,579 | 6/1967 | Steininger | 36/7.2 |
| 3,972,136 | 8/1976 | Epstein | 36/45 |
| 5,165,182 | 11/1992 | Michael | 36/7.1 R |
| 5,471,767 | 12/1995 | Walker | 36/7.2 |

*Primary Examiner*—M. D. Patterson

*Attorney, Agent, or Firm*—Thomas Moses

[57] ABSTRACT

A flexible shoe protector for shielding shoes from scratches and abrasions having an upper member that extends over a front top portion of a shoe, a lower member extending below a front sole portion of the shoe and extending rearwardly toward the heel of the shoe, and an intermediate flexible portion connected between the upper member and the lower member. The intermediate flexible portion is capable of stretching to accommodate a variety of sizes and shapes of different shoes. A flexible strap member is attached to a rearward portion of the intermediate flexible portion so that the strap member is used to stretch about a rearward portion of the shoe above the heel, for securement of the shoe cover to the shoe. The flexible strap and the intermediate portion are made from a material having elastic qualities, such as Spandex®. A rubber portion is attached to the bottom of the lower member to provide traction when a wearer is wearing the shoe protector. Optional features include the addition of reflecting material or glow-in-the-dark material to the shoe protector, for increased visibility in darkness.

8 Claims, 2 Drawing Sheets

PROTECTIVE SHOE COVER

BACKGROUND OF THE INVENTION

1. Field of the Invention

The present invention relates generally to protective shoe covers for shielding shoes from scratches and abrasions. Specifically, the present invention is a flexible shoe protector having an upper member that extends over a front top portion of a shoe, a lower member extending below a front sole portion of the shoe and extending rearwardly toward the heel of the shoe, and an intermediate flexible portion connected between the upper member and the lower member. The intermediate flexible portion is capable of stretching to accommodate a variety of sizes and shapes of different shoes. A flexible strap member is attached to a rearward portion of the intermediate flexible portion so that the strap member is used to stretch about a rearward portion of the shoe above the heel, for securement of the shoe cover to the shoe. The flexible strap and the intermediate portion are made from a material having elastic qualities, such as Spandex®. A rubber portion is attached to the bottom of the lower member to provide traction when a wearer is wearing the shoe protector. Optional features include the addition of reflecting material or glow-in-the-dark material to the shoe protector, for increased visibility in darkness.

Although the shoe protector has many different uses and applications, one application for which the shoe protector is particularly suited is for motorcycle riders, who must change gears with their feet. Motorcycle riders, and particularly riders who wear expensive dress shoes, typically scuff their shoes in the normal course of operating their motorcycles, because of the requirement that they change gears with their feet. It would be desirable to provide a flexible shoe protector that will protect shoes while a wearer is operating a motorcycle or the like. Further, it would be desirable to provide a shoe protector that may be easily attached and removed, and which would fit a variety of different sizes and shapes of shoes. When the shoe protector is not in use, it may be folded up and stored in a small space, such as in a user's pocket or saddlebag attached a motorcycle.

2. Discussion of the Prior Art

| | |
|---|---|
| Crist, et al. | 4,005,534 |
| Alegria | 4,069,599 |
| Alegria | D252,296 |
| Roda | 4,638,574 |
| McArthur, Sr. et al. | 4,780,970 |
| Cornell | D323,240 |

The Crist patent discloses a shoe protection device having a hollow metal member having an exterior shape of a shoe tip and an interior chamber of like shape communicating with a rear opening in the member. Four strap receiving loops are secured to the outer surface of the tow opposite sides of the member, two loops on one side thereof, and two loops on the other side. The loops extend outward and are positioned adjacent the rear opening, lying in a common vertical plane disposed at right angles to the direction of elongation of the member. Elongated strap means are detachably securable at each end to a corresponding set of two loops, which are used to hold the member in place on a shoe.

In the Alegria patent (4,069,599), the device disclosed is a shoe protector used for protecting the toe end portion of shoes for a drummer playing a trap set. It is formed from a single sheet of leather and has a flat sole portion that is the same general shape as the sole of the drummer's shoe. It has a pair of sides and a toe panel extending up at right angles to the sole portion, and has a tongue extending from the toe panel. The forward parts of the sides are cut away from the sole portion, turned in behind the toe panel and attached to the latter. A first pair of straps extend over the tongue to hold it securely against the arch of the drummer's foot. A second pair of straps extends around the heel of the drummer's foot to hold the formed leather piece in place of the forward part of the shoe.

The other Alegria patent (D252,296) is a design patent which is directed to the same apparatus described in the first Alegria patent (4,069,599).

The Roda patent teaches a shoe protector made up of a hard plastic toe protector adapted to slip over the toe of a shoe and half sole attached to the toe protector. An instep strap is attached to the half sole to support the half sole on a shoe and a heel strap has its ends attached to the instep strap for holding the instep strap in position. The heel strap has an adjustable buckle. A metatarsal protector for use with the shoe is also disclosed. The primary purpose of this shoe protector is to protect the wearer against injuries to the toes.

The McArthur patent discloses a shoe protector for carpet installers and others whose shoe toes are subject to abrasion and chemical abuse. The protector cup includes a pair of superior stabilizers connected to the top of the protector cup and a pair of inferior stabilizers connected to the bottom of the protector cup. A superior and inferior stabilizer are each connected to a stabilizer ring which is in turn connected to a heel strap linking the two stabilizer rings. The stabilizer rings translate the rearward force of the heel strap into pulling forces on the superior and inferior stabilizers in order to allow the protector cup to be pulled not only rearwardly against the toe of the shoe, but also downward against the shoe toe top and upward against the shoe toe bottom for maximum gripping effect on the shoe.

The Cornell patent is a design patent for a shoe safety guard, as shown and described.

SUMMARY OF THE INVENTION

Accordingly, it is an important object of the present invention to provide a shoe protector which may easily be attached to and removed from shoes, which will shield the shoes from scratches and abrasions.

It is another important object of the present invention to provide a shoe protector having flexible means allowing the shoe protector to securely fit many different sizes and shapes of shoes.

Yet another important object of the present invention to provide a shoe protector that may be folded up and stored in a compact storage space, such as in a wearer's pocket.

Another important object of the present invention to provide a shoe protector that includes reflective or glow-in-the-dark material, to increase visibility on a wearer during times of darkness.

Yet another important object of the present invention to provide a shoe protector that is easy and inexpensive to manufacture, and which overcomes some of the problems associated with other styles of shoe protectors.

These and other features, aspects, and advantages of the present invention will become better understood with regard to the following description, appended claims, and accompanying drawings.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF THE PREFERRED EMBODIMENT

Figure 1:
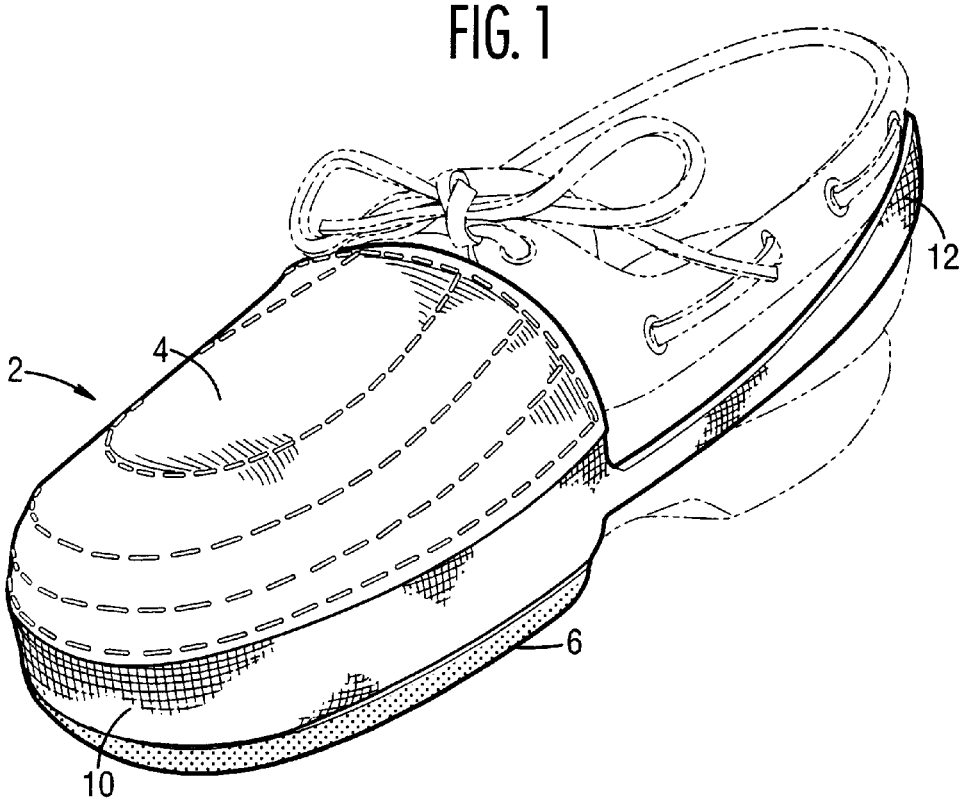
FIG. 1 is a perspective view of the shoe protector in use, where the front portion extends over the toe, tongue, and front sole portion of the shoe.

FIG. 1 shows the shoe protector 2 in use over a shoe. In a preferred embodiment, the shoe protector includes an upper, non-stretchable member 4 that covers the front upper portion of the shoe. A lower, non-stretchable member 6 is disposed beneath the sole of the shoe, extending between the front portion of the sole and rearwardly toward the heel portion of the shoe. The lower member does not extend over the heel of the shoe, and has a rubber portion 8 attached to the bottom portion of the lower member for traction during use. Although rubber is the preferred material for attachment to the lower member for traction, it is to be understood that any suitable material may be used for traction. Further, in an alternate embodiment, the upper member 4 may be made from a stretchable material, to provide a snug fit over the top of a shoe.

Figure 2:
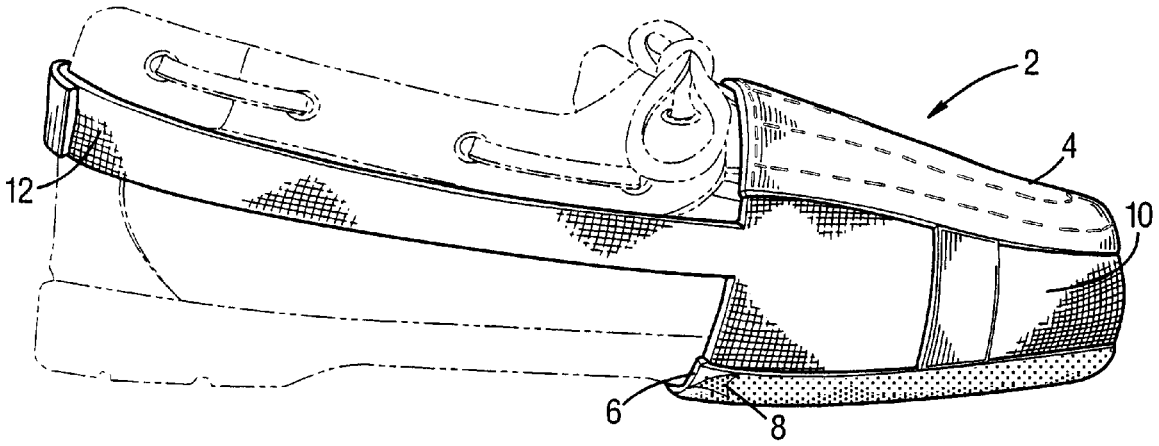
FIG. 2 is a side view of the shoe protector in use.

FIG. 2 shows a side view of the shoe protector in use. A flexible intermediate member 10 is disposed between the upper member and the lower member. The intermediate member is made from a material having elastic qualities, such as Spandex®. This flexible intermediate portion allows the shoe protector to fit a variety of different shapes and sizes of shoes. A flexible strap member 12 is attached to a rearward portion of the intermediate portion, and is used to secure the shoe protector to the shoe. The strap member attaches about a rearward portion of the shoe above the heel. Because of the flexible or elastic nature of the strap, the shoe protector may fit a variety of different sizes and shapes of shoes.

Figure 3:
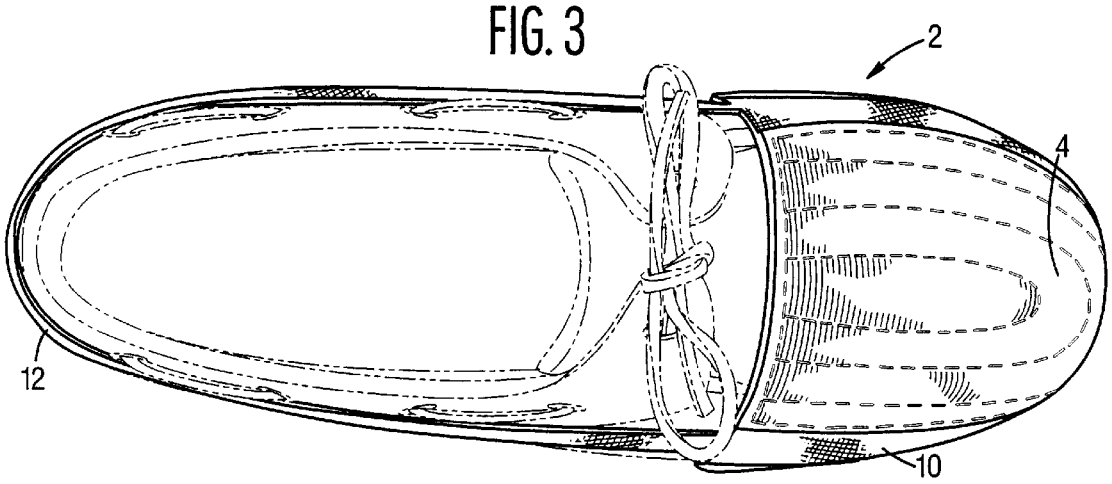
FIG. 3 is a top view of the shoe protector in use.

FIG. 3 shows a top view of the shoe protector in use over a shoe. The upper member 4 is preferably made from canvas, although any suitable non-stretchable material may be used. Reflective or glow-in-the-dark material may be applied to the upper member for ease in locating the shoe protector at night, as well as increasing the wearer's visibility to others at night.

Figure 4:
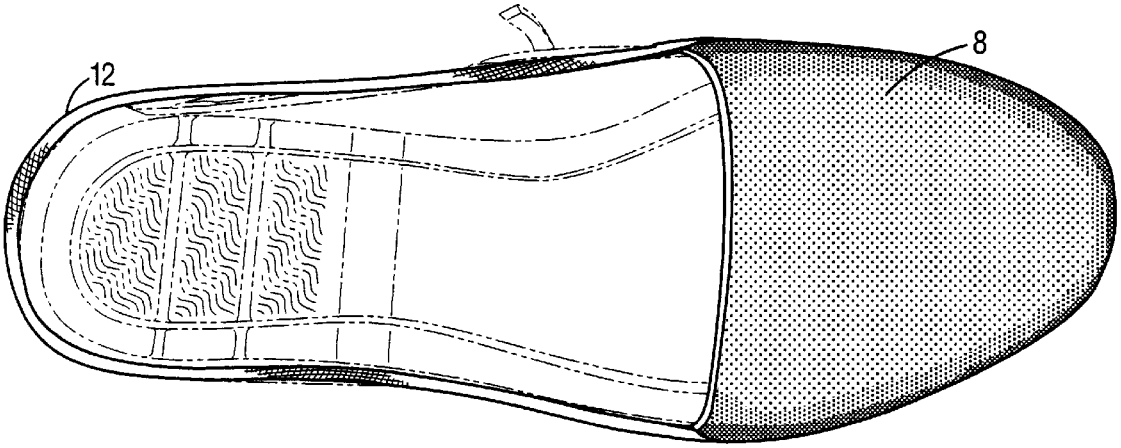
FIG. 4 is a bottom view of the shoe protector in use, also showing the rubber portion attached beneath the lower member for traction.

FIG. 4 is a bottom view of the shoe protector in use. As shown, the lower member and the rubber portion cover the front bottom portion of the sole of the shoe, without covering the heel portion. This arrangement allows easy securement and removal of the shoe protector with respect to the shoe.

The shoe protector may include reflective or glow-in-the-dark material on any suitable place, including on the flexible strap, on the intermediate flexible portion, to increase visibility of the wearer at night. When not in use, the shoe protector may be folded up and stored in a small storage space, such as in the pocket of a wearer. Further, advertising logos or trademarks may be placed on the upper member of the shoe protector, for advertising and marketing purposes. While the shoe protector has been described as having a useful application for motorcycle riders and the like, it is to be understood that the description herein is for illustrative purposes only, and many other useful applications may be found for the shoe protector. Further, it is to be understood that any type of shoes may be worn and protected by the shoe protector.

While a preferred embodiment of the invention has been described using specific terms, such description is for illustrative purposes only, and it is to be understood that changes and variations may be made without departing from the spirit or scope of the following claims.

What is claimed is:

1. A protective shoe cover for protecting shoes from scratches and abrasions, said shoe cover comprising:

an upper member comprising a single layer of nonstretchable material, said upper member extending over a front portion of a shoe;

a lower member made from nonstretchable material extending below a front sole portion of said shoe, said lower member also extending rearwardly toward a heel of said shoe, but not covering said heel portion;

a gripping portion attached to a bottom of said lower member for traction;

an intermediate flexible portion connected between said upper member and said lower member, said intermediate flexible portion capable of stretching to accommodate a variety of sizes and shapes of different shoes; and a flexible strap member integrally formed with a rearward portion of said intermediate flexible portion, wherein said flexible strap member stretches about a rearward portion of said shoe above said heel, for securement of said shoe cover to said shoe.

2. The shoe cover set forth in claim 1, wherein said upper member is made of canvas.

3. The shoe cover set forth in claim 1, wherein said intermediate flexible portion is made of an elastic material.

4. The shoe cover set forth in claim 1, wherein said gripping portion is made from rubber.

5. The shoe cover set forth in claim 1, further including reflective means attached thereto.

6. The shoe cover set forth in claim 1, further including glow in the dark material applied thereto.

7. The shoe cover set forth in claim 1, wherein said strap member is made from stretchable material.

8. The shoe cover set forth in claim 1, wherein said upper member is made from stretchable material.

* * * * *